US012286797B2

(12) United States Patent
Knapp

(10) Patent No.: US 12,286,797 B2
(45) Date of Patent: Apr. 29, 2025

(54) FASTENING SYSTEM FOR COVERING ELEMENTS

(71) Applicant: Knapp GmbH, Euratsfeld (AT)

(72) Inventor: Friedrich Knapp, Bad Kreuzen (AT)

(73) Assignee: Knapp GmbH, Euratsfeld (AT)

( * ) Notice: Subject to any disclaimer, the term of this patent is extended or adjusted under 35 U.S.C. 154(b) by 180 days.

(21) Appl. No.: 18/023,236

(22) PCT Filed: Jul. 21, 2021

(86) PCT No.: PCT/EP2021/070381
§ 371 (c)(1),
(2) Date: Feb. 24, 2023

(87) PCT Pub. No.: WO2022/053210
PCT Pub. Date: Mar. 17, 2022

(65) Prior Publication Data

US 2023/0235568 A1 Jul. 27, 2023

(30) Foreign Application Priority Data

Sep. 9, 2020 (EP) ..... 20195309

(51) Int. Cl.
*E04F 13/08* (2006.01)

(52) U.S. Cl.
CPC ..... *E04F 13/0846* (2013.01)

(58) Field of Classification Search
CPC ..... E04F 13/0846; E04F 2015/02072
See application file for complete search history.

(56) References Cited

U.S. PATENT DOCUMENTS 4,400,922 A * 8/1983 Boyer ..... E04D 3/3607 52/529
8,544,229 B2 * 10/2013 Kilgore ..... E04F 15/04 D8/382
9,297,397 B2 * 3/2016 Peck ..... F16B 5/0664
9,890,543 B2 * 2/2018 Aquilani ..... E04F 13/0819
(Continued)

FOREIGN PATENT DOCUMENTS

CN 1952320 B * 6/2010 ..... E04F 13/0814
EP 0803617 A1 10/1997
(Continued)

OTHER PUBLICATIONS

European Search Report corresponding to Application No. 20195309.8-1002, dated Mar. 15, 2021.
(Continued)

*Primary Examiner* — Joshua K Ihezie
(74) *Attorney, Agent, or Firm* — Hoffman & Baron, LLP

(57) ABSTRACT

A fastening system for covering elements, the fastening system comprising an anchoring profiled element that can be mounted to a substructure and a clip element that can be mounted to the covering element and latched to the anchoring profiled element, wherein the anchoring profiled element has at least one latching protrusion on each of two opposite faces and the clip element has the shape of a U with a central web and two legs, and wherein, in the latched position, the clip element extends over the anchoring profiled element in the manner of a clamp and each leg latches to a latching protrusion in the manner of a snap hook.

16 Claims, 3 Drawing Sheets

(56) References Cited

U.S. PATENT DOCUMENTS

| | | | | |
|---|---|---|---|---|
| 10,119,273 | B2 * | 11/2018 | Andres | E04F 15/02458 |
| 11,060,304 | B1 * | 7/2021 | Spanovich | E04F 15/105 |
| 11,946,262 | B2 * | 4/2024 | Bouck | E04F 15/105 |
| 2013/0025228 | A1 * | 1/2013 | Kilgore | E04F 15/02183<br>403/375 |
| 2014/0260041 | A1 * | 9/2014 | Peck | E04F 15/02183<br>52/489.1 |
| 2017/0002572 | A1 * | 1/2017 | Wagner | E04F 13/0821 |
| 2021/0277665 | A1 * | 9/2021 | Bilge | E04F 13/081 |
| 2024/0052641 | A1 * | 2/2024 | Bouck | E04F 15/02038 |

FOREIGN PATENT DOCUMENTS

| | | | | |
|---|---|---|---|---|
| WO | WO-2007051934 | A1 * | 5/2007 | E04F 15/02 |
| WO | 2015140475 | A1 | 9/2015 | |
| WO | 2020147442 | A1 | 7/2020 | |

OTHER PUBLICATIONS

International Search report corresponding to International Application No. PCT/EP2021/070381, dated Sep. 1, 2021.

Second European Search Report corresponding to Application No. 22198734.0-1005, dated Nov. 7, 2022.

PCT International Preliminary Report on Patentability corresponding to International Application No. PCT/EP2021/070381 dated Mar. 7, 2023.

* cited by examiner

FASTENING SYSTEM FOR COVERING ELEMENTS

CROSS-REFERENCE TO RELATED APPLICATIONS

This application is a National Phase application of International Application No. PCT/EP2021/070381 filed Jul. 21, 2021 which claims priority to the European Patent Application No. 20 195 309.8 filed Sep. 9, 2020, the disclosures of which are incorporated herein by reference.

TECHNICAL FIELD

The present disclosed subject matter relates to a fastening system for covering elements, comprising an anchoring profiled element that can be mounted to a substructure and a clip element that can be mounted to the covering element and latched to the anchoring profiled element.

BACKGROUND

Numerous clip systems are already known for fastening covering elements, e.g. for fastening façade strips to façades, wall panels to internal walls, floorboards to floors, etc. These known systems are either complex to manufacture, laborious to mount, or not sufficiently adjustable and/or durable.

BRIEF SUMMARY

The aim of the disclosed subject matter is to provide an improved fastening system which overcomes the drawbacks of the prior art.

This aim is achieved by a fastening system of the type mentioned at the outset which, according to the disclosed subject matter, is distinguished in that the anchoring profiled element has at least one latching protrusion on each of two opposite faces and the clip element has the shape of a U with a central web and two legs, wherein, in the latched position, the clip element engages over the anchoring profiled element in the manner of a clamp and each leg latches to a latching protrusion in the manner of a snap hook.

The fastening system of the disclosed subject matter makes it possible to fasten a covering element to a substructure, e.g. a slatted frame, a wall, a floor, etc., in a simple manner and to securely retain it thereon. The two parts, i.e. the anchoring profiled element and the clip element, are simple to manufacture and the anchoring profiled element can be produced to any length. In a first variant of the disclosed subject matter, one long, continuous anchoring profiled element can be used for a plurality of clip elements, for instance, such that the anchoring profiled elements themselves form a slatted frame, so to speak, onto which the covering elements can be clipped by means of the clip elements. In an alternative variant, one separate, short anchoring profiled element can be used per clip element, such that rainwater can penetrate and drain off unhindered between individual, spaced-apart fastening systems each composed of one clip element and one anchoring profiled element.

In the first variant, the length of the anchoring profiled element in the longitudinal profile direction is optionally at least twice, e.g. at least three times, the length of a clip element, the fastening system comprising at least two clip elements per anchoring profiled element. In the second variant, the anchoring profiled element and the clip element are optionally substantially the same length in the longitudinal profile direction.

In an advantageous embodiment of the disclosed subject matter, the end faces of the anchoring profiled element are configured as mutually complementary plug-in connections, by means of which two anchoring profiled elements can be plugged together with a press fit in the longitudinal profile direction. As a result, two fastening systems, e.g. each composed of one clip element and one anchoring profiled element, can be plugged together to form one wider fastening system that is twice as strong, for example in order to fasten heavy covering elements.

According to a further feature of the disclosed subject matter, on its rear face facing away from the legs, the web of the clip element bears at least one projecting rib, which is configured to engage in a groove in the covering element with a press fit. If the covering element has a groove that is longer than the rib, for example a groove that extends over the entire length of its rear face, the covering element can be attached to the clip element at any point along the groove and can thus be adjusted accordingly.

The rib is optionally provided with channels or a latching lug, e.g. on its two flat faces, in order to ensure that the covering element is retained effectively.

In a further embodiment, the rear face can bear two parallel ribs, which are provided with latching lugs pointing away from one another at their protruding ends and are configured to engage in a sprung manner in a groove in the covering element that is T-shaped in cross section. As a result, the covering element can be clipped to the clip element.

The latching protrusions of the anchoring profiled element can, for example, be formed at the two opposite end faces of the anchoring profiled element. Alternatively, however, said faces of the anchoring profiled element, which bear the latching protrusions, extend in parallel with the longitudinal profile direction of the anchoring profiled element. As a result, the latching protrusions can be formed as parts of the profile cross section passing through in the longitudinal profile direction and the clip element can be clipped on at any point in the longitudinal profile direction of the anchoring element. This is particularly useful in any variant of the fastening system in which a longer anchoring profiled element shared by a plurality of clip elements is used, which forms a slatted frame for the covering elements, so to speak.

According to a further embodiment of the disclosed subject matter, the anchoring profiled element bears one connecting part and the clip element bears the other connecting part of a tongue-and-groove joint, which blocks the clip element from shifting in the longitudinal profile direction of the anchoring profiled element in the position in which the clip element is latched to the anchoring profiled element. In any variant of the fastening system in which the anchoring profiled element is the same length as the clip element, this prevents the clip element and anchoring profiled element from slipping or only partially overlapping in the longitudinal profile direction. In the other variant of the fastening system comprising a longer anchoring profiled element passing through a plurality of clip elements, a regular arrangement of the clip elements and thus the covering elements can be predefined by means of tongue-and-groove joints of this kind.

It is particularly beneficial for the legs to latch releasably to the respective latching protrusion. As a result, the covering elements can also be removed from the substructure again, for example for cleaning, repair, or replacement.

It is particularly advantageous for the anchoring profiled element to be provided with at least one groove or through-hole extending in the longitudinal profile direction for leading through a cable, pipe, cable pull, or the like. The anchoring profiled elements can thus be simultaneously used for fixing installations in place or for mechanical tensioning behind the covering elements.

BRIEF DESCRIPTION OF THE DRAWINGS

The disclosed subject matter will be explained in greater detail in the following with reference to exemplary embodiments shown in the accompanying drawings, in which.

DETAILED DESCRIPTION

Figure 2:
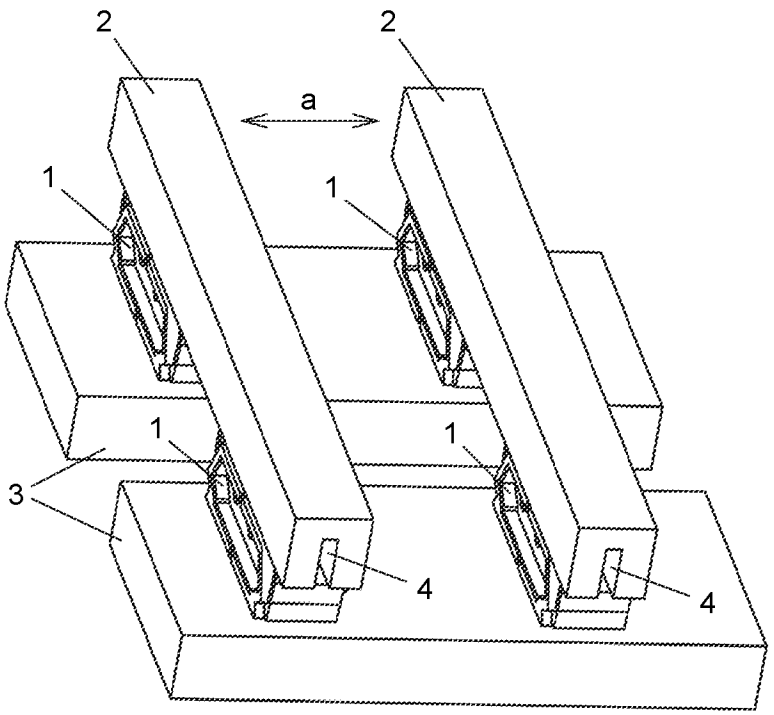
FIGS. 1 and 2 show a first embodiment of the fastening system of the disclosed subject matter in an exploded perspective view (FIG. 1) and a perspective view of an exemplary usage position (FIG. 2)
Figure 1:
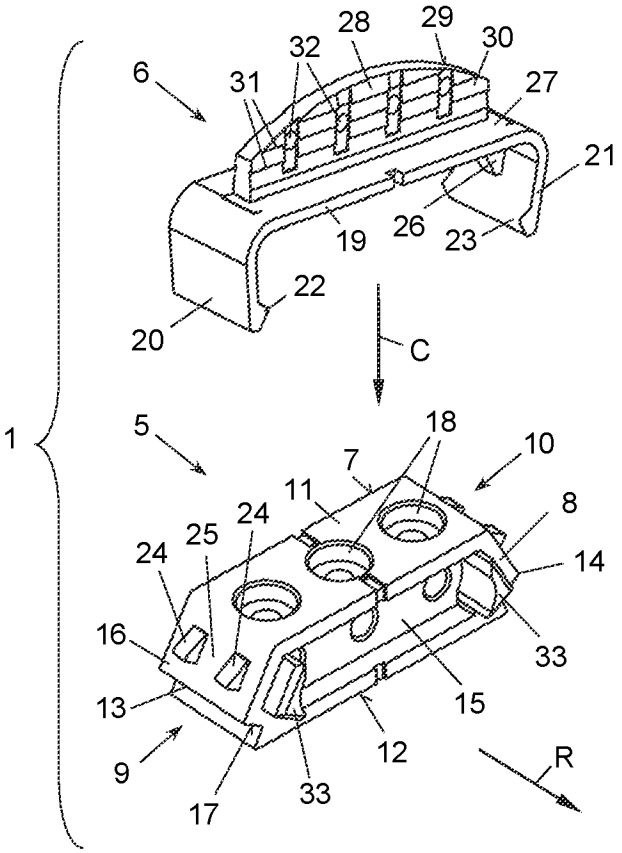

FIGS. 1 and 2 show a fastening system 1 for fastening covering elements 2 to a substructure 3. The covering elements 2 may be façade strips, façade sheets, wall panels, floorboards, tiles, etc., for example. For example, the substructure 3 may be a slatted frame, an internal or external wall, floor screed, etc.

In the example shown, the covering elements 2 are façade strips which are intended to be attached vertically to the external wall of a building, for example, and each have a longitudinal groove 4 on its rear face. The façade strips 2 are, for example, fastened to the substructure 3 with consistent mutual spacing a by means of two or more fastening systems 1 distributed over its longitudinal extension.

Each fastening system 1 comprises an anchoring profiled element 5 that can be mounted to the substructure 3 and a clip element 6 that can be mounted to a covering element 2 and latched to the anchoring profiled element 5.

In the embodiment in FIGS. 1 and 2, the anchoring profiled element 5 is in the shape of a small block having a longitudinal profile direction R, end profile faces 7, 8, lateral faces 9, 10, and upper and lower faces 11, 12. The anchoring profiled element 5 comprises at least one latching protrusion 13, 14 on each of the opposite lateral faces 9, 10. The latching protrusions 13, 14 could, however, also be arranged on the end faces 7, 8, for example could be formed by central indentations or undercuts 15 in the end faces 7, 8.

In the example shown, the latching protrusions 13, 14 each have a cross section in the approximate shape of an isosceles triangle on the lateral faces 9, 10 when viewed in the longitudinal profile direction R, i.e. are chamfered relative to the clipping direction C of the clip element 6 both on its upper face 16 and on its lower face 17.

The anchoring profiled element 5 can be glued to, nailed to, or embedded in the substructure, for example set into plaster or concrete therein. In the example shown, the anchoring profiled element 5 is screwed to the substructure 3 and, for this purpose, comprises one or more holes 18, extending from the upper face to the lower face 11, 12, for corresponding fastening screws.

The clip element 6 is substantially in the shape of a U having a central web 19 and two legs 20, 21 hanging down from the ends thereof. The legs 20, 21 have latching lugs 22, 23 at their ends which each point inwards, i.e. face one another, and thus form snap hooks, because the legs 20, 21 and/or the web 19 are slightly resilient.

In the position (FIG. 2) in which the clip element 6 is latched to the anchoring profiled element 5, the clip element 6 engages over the anchoring profiled element 5 in a clamp-like manner, with each snap-hook leg 20, 21 latching to a latching protrusion 13, 14, or, more specifically, the latching lugs 22, 23 making contact behind the latching protrusions 13, 14 on the lower faces 17 thereof.

Owing to the largely uniform configuration of the upper and lateral faces 9-11 of the anchoring profiled element 5 in the longitudinal profile direction R, the clip element 6 latched to the anchoring profiled element 5 can be shifted in the longitudinal profile direction R, for example for adjustment purposes. If this is not desired, at least one tongue-and-groove joint, which blocks this kind of shifting, can additionally be provided between the anchoring profiled element 5 and the clip element 6. In this case, one of the parts out of the anchoring profiled element 5 and the clip element 6 bears one connecting part and the other part bears the other connecting part of the tongue-and-groove joint.

In the example shown, for this purpose, a groove 25 formed between two protrusions 24, in which a tongue 26 formed on the inner faces of the legs 20, 21 engages in each case, is provided on the upper faces 16 of the latching protrusions 13, 14 of the anchoring profiled element 5 in order to fix the clip element 6 in the latching position in the longitudinal profile direction R. It goes without saying that the tongue-and-groove joint 25, 26 can also be produced in another way by accordingly complementary configurations between the anchoring profiled element 5 and the clip element 6.

For mounting the clip element 6 to the respective covering element 2, the web 19 bears a projecting rib 28 on its rear face 27 facing away from the legs 20, 22. The rib 28 engages in the groove 4 in the covering element 2 with a press fit. In the example shown, the rib 28 is approximately in the shape of a fin and has channels or latching lugs 31 on its two flat faces 29, 30 which improve the press fit when the rib 28 is pressed into the groove 4 in the covering element 2.

In order to improve the retention of the covering elements 2 on the clip elements 6, the ribs 28 can additionally be glued into the grooves 4. It is also possible to additionally screw the clip element 6 to the covering element 2, for example by means of screws that penetrate the web 19 and reach into the rear face of the covering element 2 or by means of screws which are screwed into a covering element 2 from the side and penetrate the rib 28. For this purpose, the rib 28 can also comprise holes 32 for these screws to pass through.

During mounting, in the first step the anchoring profiled elements 5 are anchored to the substructure 3, for example by means of screws through the holes 18. Then, either the clip elements 6 are first latched to the mounted anchoring profiled elements 5 and the covering elements 2 are then attached to the ribs 28, or the clip elements 6 comprising the ribs 28 are first inserted into the grooves 4 in the covering elements 2 and then the covering elements 2 together with the clip elements 6 are latched to the anchoring profiled elements 5.

For heavy covering elements 2, for example heavy façade sheets, a plurality of fastening systems 1 can also be connected to form a larger double, triple, or multiple fastening system. To do this, the anchoring profiled elements 5 of a plurality of fastening systems 1 can be plugged together in the manner of building blocks, for example. For this purpose, the end faces 7, 8 of the anchoring profiled elements 5 are each equipped with mutually complementary plug-in connections, by means of which two anchoring profiled elements 5 are plugged together with a press fit in the longitudinal profile direction R in each case. For example, one end face 8 can be provided with pins 33, which can be inserted into recesses 15 in the other end face 7.

The anchoring profiled elements 5 plugged together in this way can be fastened to the substructure 3 more easily than a plurality of individual anchoring profiled elements 5. For example, of a group of plugged-together anchoring profiled elements 5, only the outermost anchoring profiled elements 5 need to be screwed to the substructure 3, while the middle anchoring profiled elements 5 of the anchoring profiled elements 5 at the edge of the group are retained by the plug-in connections 15, 33.

It goes without saying that the plug-in connections 15, 33 can also be provided by other complementary configurations of the end faces 7, 8 of the anchoring profiled elements 5, in particular also by configuring the end faces 7, 8 to have mirror-inverted symmetry.

Figure 4:
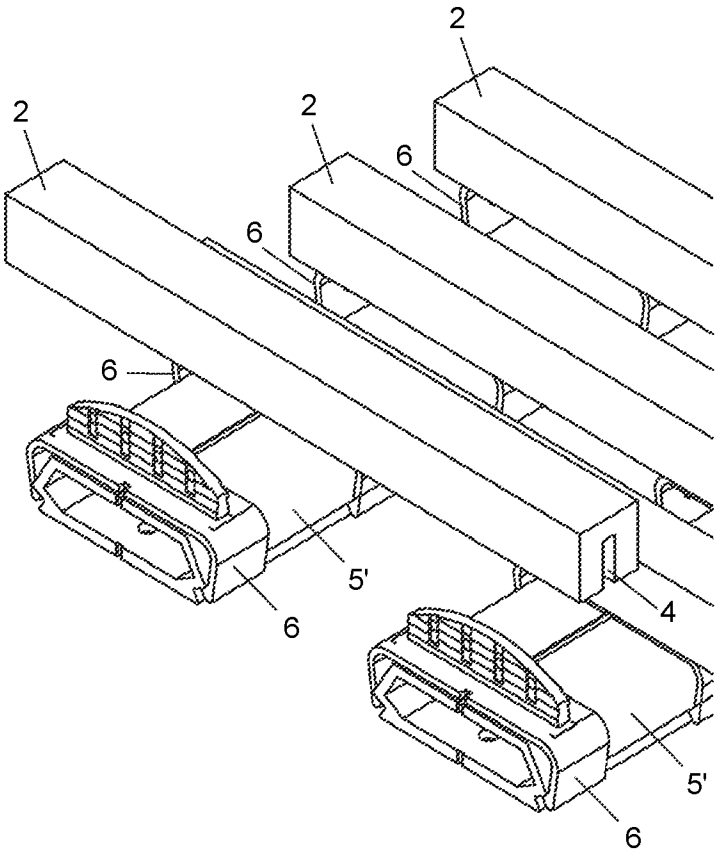
FIGS. 3 and 4 show a second embodiment of the fastening system of the disclosed subject matter in an exploded perspective view (FIG. 3) and a perspective view of an exemplary usage position (FIG. 4)
Figure 3:
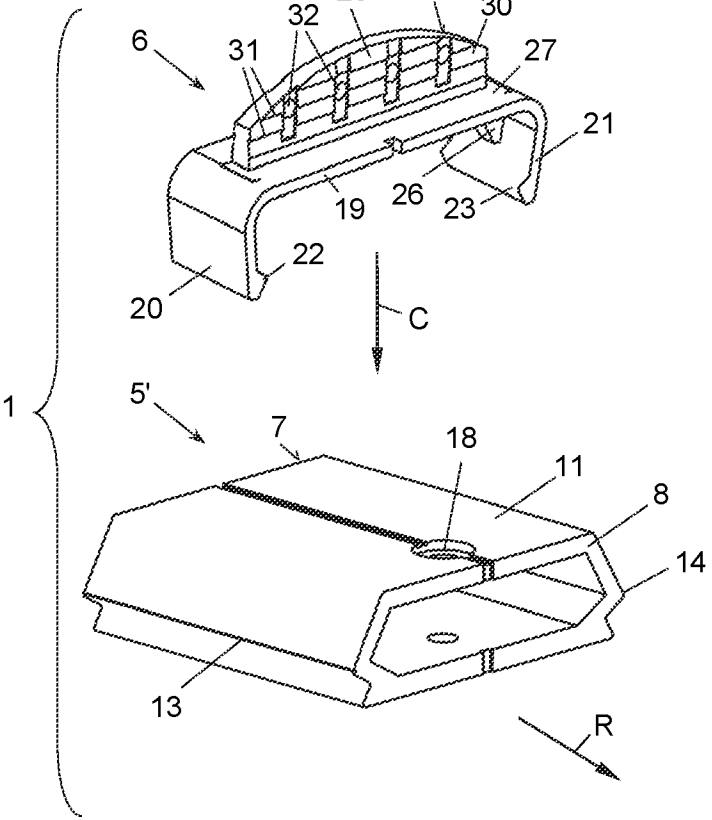

FIGS. 3 and 4 show a further embodiment of the fastening system 1 in which the anchoring profiled element has been slightly modified and is denoted by reference sign 5'. Otherwise, the same reference signs denote the same parts as in FIGS. 1 and 2.

The anchoring profiled element 5' of the fastening system 1 in FIGS. 3 and 4 is considerably longer than a clip element 6 in the longitudinal profile direction R and can thus itself form a slatted frame, so to speak, which is between the covering elements 2 and a substructure 3 (not shown in FIG. 4). A plurality of clip elements 6, for example with consistent spacing a, can thus equally be latched to a single anchoring profiled element 5'.

The anchoring profiled element 5' can be provided in prefabricated lengths or can be accordingly cut to length on site when being mounted. In order to predefine the intervals a between the covering elements 2, the anchoring profiled element 5' can, for example, be equipped with one of the parts (grooves 25 or tongues 26) of tongue-and-groove joints 25, 26 with consistent spacing a. It is also possible for the long anchoring profiled elements 5' in FIGS. 3 and 4 to be equipped at their end faces 7, 8 with complementary plug-in connections 15, 33, such that they can be plugged together to form even longer anchoring profiled elements.

Figure 5:
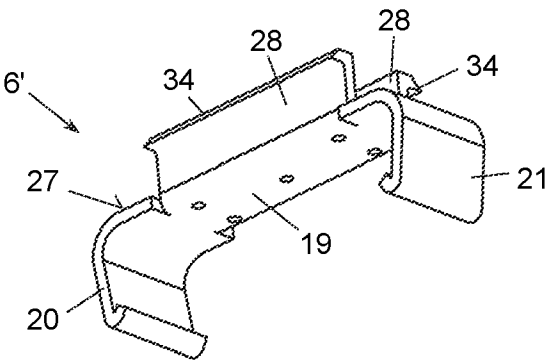
FIGS. 5 and 6 show an alternative embodiment of the clip element of the fastening systems in FIGS. 1 to 4 in a perspective view (FIG. 5) and a perspective view of an exemplary usage position (FIG. 6)
Figure 6:
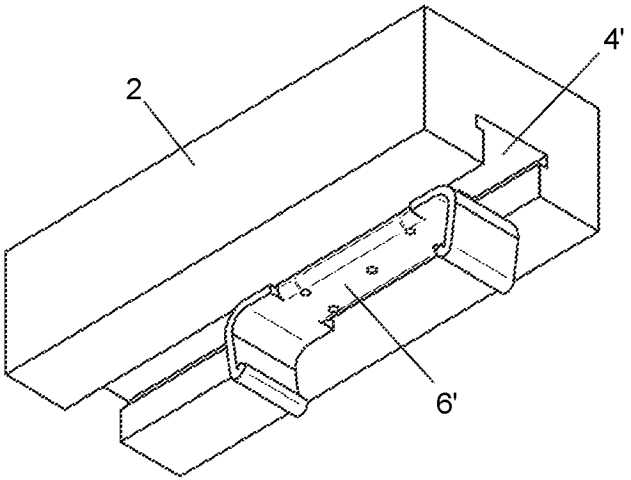

FIGS. 5 and 6 show a further embodiment of the clip element 6, which is denoted by reference sign 6' here. The clip element 6' bears two parallel ribs 28, which are adjacent with mutual spacing, on the rear face 27 of its web 19. The ribs 28 are each provided with latching lugs 34 pointing away from one another at their protruding, i.e. free, ends. Owing to their slight resilience and/or the slight resilience of the web 19, the ribs 28 thus form spring hooks facing away from one another, which can snap in a sprung manner into a groove 4' in the covering element 2 that is T-shaped in cross section (FIG. 6).

Figure 7:
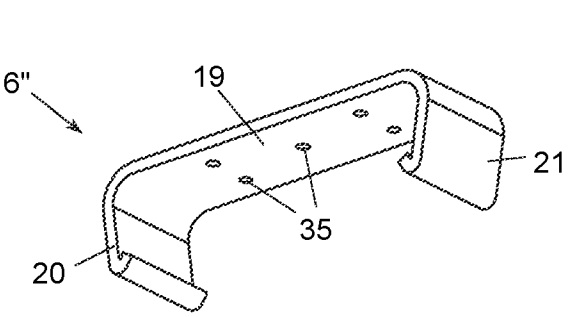
FIG. 7 again shows a further embodiment of the clip element of the fastening systems in FIGS. 1 to 4 in a perspective view.

FIG. 7 shows a simplified embodiment of the clip element, which is denoted by reference sign 6" here. The clip element 6" does not have a rib/ribs 28 and is, for example, glued or screwed to the rear face of the covering elements 2, for example by means of holes 35 for screws to pass through. Moreover, holes 35 of this kind can also be used in the clip elements 6, 6'.

Figure 8:
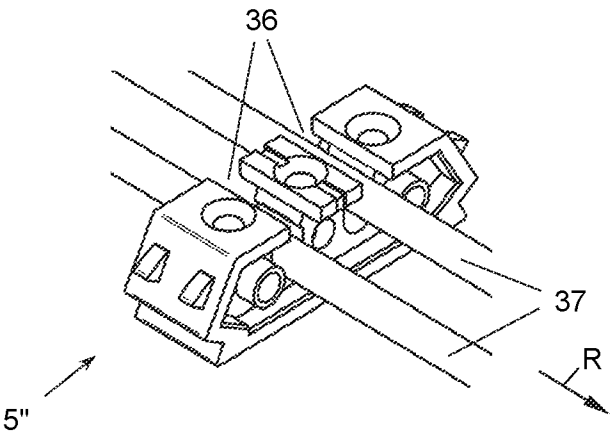
FIG. 8 shows a further embodiment of the anchoring element of the fastening systems in FIGS. 1 to 4 in a perspective view of an exemplary usage position.

FIG. 8 shows a further embodiment of the anchoring profiled element, which is denoted by reference sign 5" here. The anchoring profiled element 5" is equipped with one or more grooves or through-holes 36 extending in the longitudinal profile direction R for leading through cables, pipes, cable pulls, or the like 37. As a result, electrical installations, water mains installations, mechanical actuators, Bowden cables, tensioning wires, etc., can be guided behind a façade equipped with covering elements 2, for example.

The anchoring profiled elements 5, 5', 5" and clip elements 6, 6', 6" can be made of any suitable material, for example plastics material or metal, such as steel or aluminum.

The disclosed subject matter is not limited to the embodiments set out, but instead covers all the variants, modifications, and the combinations thereof that fall within the scope of the accompanying claims.

What is claimed is:

1. A fastening system for covering elements, comprising an anchoring profiled element that has a longitudinal profile direction, two opposite profile end faces, each of which at a respective longitudinal end of the anchoring profiled element, two opposite lateral faces, each of which extending in parallel with the longitudinal profile direction at a respective lateral side of the anchoring profiled element, and upper and lower faces at an upper and lower side of the anchoring profiled element, respectively, and can be mounted to a substructure and a clip element that can be mounted to the covering element and latched to the anchoring profiled element, wherein the anchoring profiled element has at least one latching protrusion on each of the two opposite lateral faces and the clip element has a shape of a U with a central web and two legs, wherein, in a latched position, the clip element engages over the anchoring profiled element in a manner of a clamp and each leg latches to a latching protrusion in a manner of a snap hook, and wherein the profile end faces of the anchoring profiled element are configured as mutually complementary plug-in connections, by means of which two anchoring profiled elements can be plugged together with a press fit in a longitudinal profile direction.

2. The fastening system according to claim 1, wherein a length of the anchoring profiled element in the longitudinal profile direction is at least twice a length of each clip element, the fastening system comprising at least two clip elements per anchoring profiled element.

3. The fastening system according to claim 1, wherein the anchoring profiled element and the clip element are substantially a same length in the longitudinal profile direction.

4. The fastening system according to claim 1, wherein, on a rear face facing away from the legs, the web bears at least one projecting rib, which is configured to engage in a groove in the covering element with a press fit.

5. The fastening system according to claim 4, wherein the rear face bears two parallel ribs, which are provided with latching lugs pointing away from one another at protruding ends and are configured to engage in a sprung manner in a groove in the covering element that is T-shaped in cross section.

6. A fastening system for covering elements, comprising an anchoring profiled element that has a longitudinal profile direction, two opposite profile end faces, each of which at a respective longitudinal end of the anchoring profiled element, two opposite lateral faces, each of which extending in parallel with the longitudinal profile direction at a respective lateral side of the anchoring profiled element, and upper and lower faces at an upper and lower side of the anchoring profiled element, respectively, and can be mounted to a substructure and a clip element that can be mounted to the covering element and latched to the anchoring profiled element, wherein the anchoring profiled element has at least one latching protrusion on each of the two opposite lateral faces and the clip element has a shape of a U with a central web and two legs, wherein, in a latched position, the clip element engages over the anchoring profiled element in a manner of a clamp and each leg latches to a latching protrusion in a manner of a snap hook, and wherein the anchoring profiled element bears one connecting part and the clip element bears the other connecting part of a tongue-and-groove joint, which blocks the clip element from shifting in the longitudinal profile direction of the anchoring profiled element in a position in which the clip element is latched to the anchoring profiled element.

7. The fastening system according to claim 1, wherein the legs latch releasably to the respective latching protrusion.

8. The fastening system according to claim 1, wherein the anchoring profiled element is provided with at least one groove or through-hole extending in the longitudinal profile direction for leading through a cable, pipe or, cable pull.

9. The fastening system according to claim 2, wherein the length of the anchoring profiled element in the longitudinal profile direction is at least three times the length of each clip element.

10. The fastening system according to claim 6, wherein a length of the anchoring profiled element in the longitudinal profile direction is at least twice a length of each clip element, the fastening system comprising at least two clip elements per anchoring profiled element.

11. The fastening system according to claim 6, wherein the anchoring profiled element and the clip element are substantially a same length in the longitudinal profile direction.

12. The fastening system according to claim 10, wherein the length of the anchoring profiled element in the longitudinal profile direction is at least three times the length of each clip element.

13. The fastening system according to claim 6, wherein, on a rear face facing away from the legs, the web bears at least one projecting rib, which is configured to engage in a groove in the covering element with a press fit.

14. The fastening system according to claim 13, wherein the rear face bears two parallel ribs, which are provided with latching lugs pointing away from one another at protruding ends and are configured to engage in a sprung manner in a groove in the covering element that is T-shaped in cross section.

15. The fastening system according to claim 6, wherein the legs latch releasably to the respective latching protrusion.

16. The fastening system according to claim 6, wherein the anchoring profiled element is provided with at least one groove or through-hole extending in the longitudinal profile direction for leading through a cable, pipe or cable pull.

* * * * *